US007193574B2

(12) United States Patent
Chiang et al.

(10) Patent No.: US 7,193,574 B2
(45) Date of Patent: Mar. 20, 2007

(54) ANTENNA FOR CONTROLLING A BEAM DIRECTION BOTH IN AZIMUTH AND ELEVATION

(75) Inventors: Bing A. Chiang, Melbourne, FL (US); Michael James Lynch, Merritt Island, FL (US); Steven Jeffrey Goldberg, Downingtown, PA (US)

(73) Assignee: InterDigital Technology Corporation, Wilmington, DE (US)

( * ) Notice: Subject to any disclaimer, the term of this patent is extended or adjusted under 35 U.S.C. 154(b) by 40 days.

(21) Appl. No.: 11/065,752

(22) Filed: Feb. 25, 2005

(65) Prior Publication Data

US 2006/0082514 A1 Apr. 20, 2006

Related U.S. Application Data

(60) Provisional application No. 60/619,763, filed on Oct. 18, 2004.

(51) Int. Cl.
*H01Q 3/00* (2006.01)

(52) U.S. Cl. ..... 343/757

(58) Field of Classification Search ..... 343/757, 343/833, 834, 795, 797, 700 MS, 745
See application file for complete search history.

(56) References Cited

U.S. PATENT DOCUMENTS

| | | | | |
|---|---|---|---|---|
| 4,780,724 | A * | 10/1988 | Sharma et al. | 343/700 MS |
| 6,323,815 | B1 * | 11/2001 | Rao et al. | 343/753 |
| 6,369,770 | B1 | 4/2002 | Gothard et al. | 343/794 |
| 7,034,761 | B2 * | 4/2006 | Chiang et al. | 343/745 |

* cited by examiner

*Primary Examiner*—Tuyet Vo
*Assistant Examiner*—Huedung Mancuso
(74) *Attorney, Agent, or Firm*—Volpe and Koenig, P.C.

(57) ABSTRACT

An antenna for controlling a beam direction both in azimuth and elevation is disclosed. An antenna comprises a ground plane, at least one active element, and a plurality of passive elements. Both an upper half and a lower half of the passive elements are connected to the ground plane with variable reactive loads, whereby elevation angle of the radio beam is controlled by adjusting the variable reactive loads. Alternatively, an antenna may comprise a radio frequency (RF) choke coupled to the ground plane, whereby an elevation angle of the radio beam is controlled by controlling the RF choke. Alternatively, an antenna comprises a variable lens for changing a wave front of a radio wave which is passing through the variable lens, whereby the beam width and direction are controlled by the variable lens.

30 Claims, 5 Drawing Sheets

ANTENNA FOR CONTROLLING A BEAM DIRECTION BOTH IN AZIMUTH AND ELEVATION

CROSS REFERENCE TO RELATED APPLICATION

This application claims the benefit of U.S. Provisional Application No. 60/619,763 filed Oct. 18, 2004, which is incorporated by reference as if fully set forth.

FIELD OF INVENTION

The present invention is related to an antenna. More particularly, the present invention is related to an antenna for controlling a beam direction both in azimuth and elevation.

BACKGROUND

One of the most important issues currently with wireless communication systems is how to increase the capacity of the wireless communication system. One of the new areas being explored is the use of directional antennas to improve the link margin of the forward and reverse links between base stations and wireless transmit/receive units (WTRUs). The increased gain of the directional antenna over the typical omni-directional antenna provides an increased received signal gain at the WTRU and the base station.

A passive-antenna array, such as shown in the three-dimensional view of a prior art smart antenna 100 of FIG. 1, has been developed as an efficient and low cost smart antenna for Subscriber Based Smart Antenna (SBSA). The smart antenna 100 comprises one active element 102 disposed in the center top portion of a ground plane 106 and three passive elements 104 surrounding the active element 102. Each passive element 104 comprises an upper half 104*a* and a lower half 104*b*. The upper halves 104*a* of the passive elements 104 are connected to the ground plane 106 through reactive loads 112, respectively. The reactive loads 112 are variable reactance, which is changeable from capacitive to inductive by using varactors, transmission lines or switching. By varying the reactive loads 112, the radiation pattern can be changed. The lower halves 104*b* of the passive elements 104 are directly connected, (i.e., shorted), to the ground plane 106. Since the lower half 104*b* is shorted, the beam is tilted upward, which degrades the capability of steering a beam in elevation. The smart antenna 100 is capable of forming and steering a beam only in azimuth, not in elevation. With the need of enhanced capacity of a wireless communication system, more refined use of smart antennas requires the beam to be steered in both azimuth and elevation.

FIG. 2 is a diagram of another prior art smart antenna 200. The smart antenna 200 has a similar configuration as the smart antenna 100. However, the difference is the number of passive elements 204. The smart antenna 200 comprises one active element 202 and two passive elements 204. The upper halves 204*a* of the passive elements 204 are connected to the ground plane 206 through variable reactances 212, but the lower halves 204*b* are shorted to the ground plane 206. Since the lower halves 204*b* of the passive elements 204 are shorted to the ground plane 206, the beam is tilted upward, which degrades the capability of steering a beam in elevation.

Edge impedance of the ground plane is also a cause of beam tilt. Many antennas are built on a finite ground plane, which has the advantage of providing an easy interface with, and good isolation from, the remainder of the wireless communication system. However, beam tilt is inevitable because the edges of the ground plane operate as a radiation scatterer. The ground plane absorbs and re-radiates the radio wave and the re-radiated radio wave interferes with the antennas' direct radiation, thereby resulting in a tilted beam.

The ground plane is finite with respect to the wavelength of transmitted and received signals. This is especially true when the smart antenna is implemented in a WTRU, where the overall size of the antenna is restricted. Because of the interaction between the small ground plane and the antenna element, the beam is tilted upward. Accordingly, the strength of the beam along the horizon is decreased.

In steering a beam both in azimuth and elevation, it is desirable to vary the beam width of an antenna in elevation. Fixed elevation beam width antennas can cover a fixed elevation sector. Some locations may require a larger coverage in elevation, but some locations may require a smaller coverage in elevation. Generally, a narrower beam can provide more gain and larger information capacity. Therefore, there is a need for adjusting the beam width in elevation.

SUMMARY

The present invention is related to an antenna for controlling beam direction both in azimuth and elevation. An antenna comprises a ground plane, at least one active element, and a plurality of passive elements. The active element, which is installed on top of the ground plane while electrically isolated from the ground plane, radiates a radio beam. A plurality of passive elements are disposed around the outer edge of the ground plane surrounding the active element. Each passive element comprises an upper half and a lower half. The upper half includes a variable reactive load which connects the upper half to the ground plane and the lower half includes a variable reactive load which connects the lower half to the ground plane. Each lower half is vertically aligned with a respective corresponding upper half. The elevation angle of the radio wave radiated from the antenna is controlled by adjusting the variable reactive loads in the upper and lower halves.

In accordance with another embodiment, an antenna comprises a radio frequency (RF) choke coupled to the ground plane, whereby the elevation angle of the radio beam is controlled by controlling the RF choke. The type of antenna or antenna array mounted on the ground plane can be of any type, utilizing a combination of active or passive antenna elements. They can be perpendicular to the ground plane, or angled relative to each other to provide polarization diversity in two or three dimensions.

In accordance with another embodiment, an antenna comprises a variable lens for changing the wave front of a radio wave which is passing through the variable lens, whereby a beam width is controlled by the variable lens.

DETAILED DESCRIPTION OF THE PREFERRED EMBODIMENTS

Hereinafter, the terminology "WTRU" includes but is not limited to a user equipment, a mobile station, a fixed or mobile subscriber unit, a pager, or any other type of device capable of operating in a wireless environment. Hereinafter, the terminology "base station" includes but is not limited to a Node-B, a site controller, an access point or any other type of interfacing device in a wireless environment. A smart antenna disclosed hereinafter may be implemented both in a WTRU and a base station.

Figure 1:
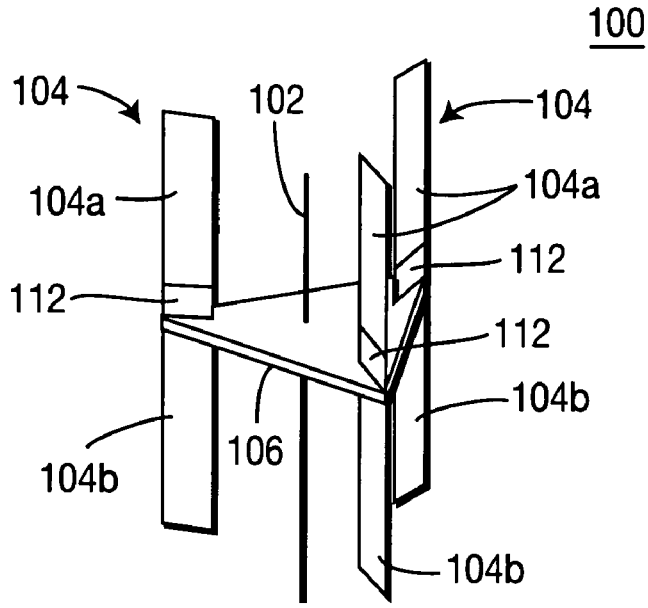
FIG. 1 PRIOR ART
FIG. 1 is a three-dimensional view of a prior art smart antenna array with one active element and three passive elements.
Figure 2:
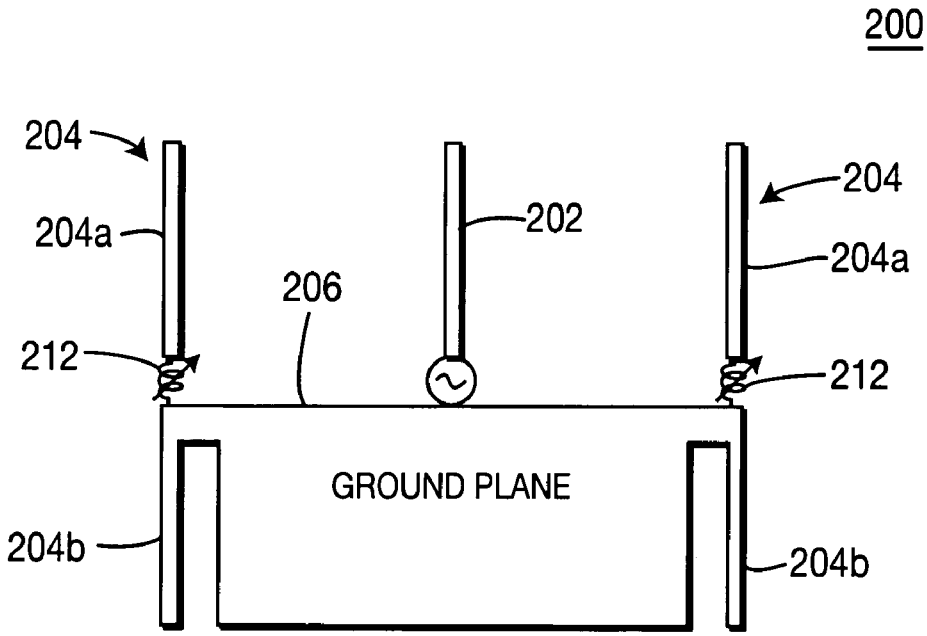
FIG. 2 PRIOR ART
FIG. 2 is a diagram of the prior art smart antenna with one active element and two passive elements
Figure 3:
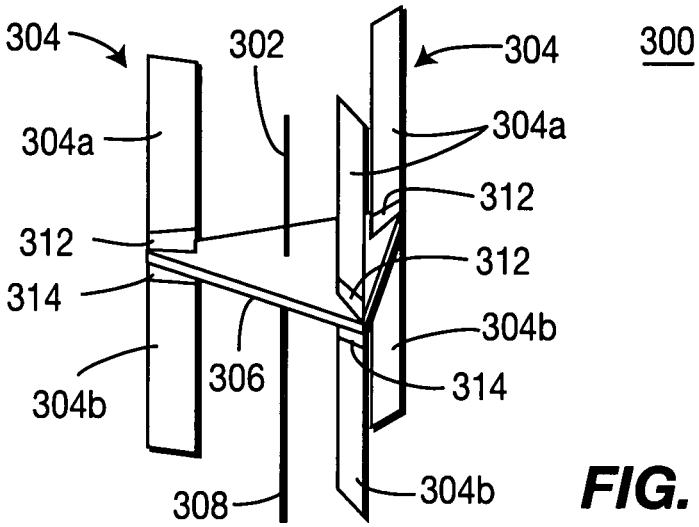
FIG. 3 is a three-dimensional view of a smart antenna with one active element and three passive elements in accordance with the present invention.
Figure 4:
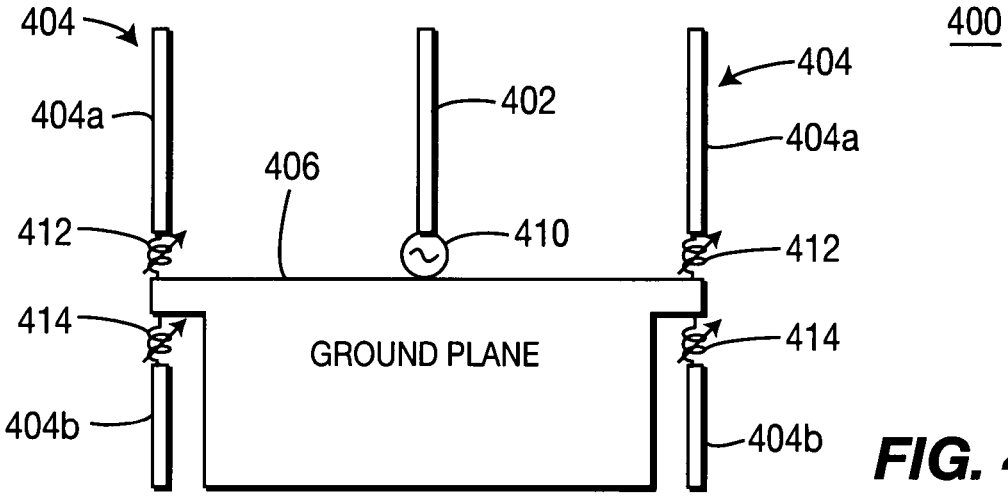
FIG. 4 is a diagram of the smart antenna with one active element and two passive elements in accordance with the present invention.

FIG. 3 is a three-dimensional view of a delta array smart antenna 300 with one active element and three passive elements, and FIG. 4 is a diagram of a smart antenna 400 with one active element and two passive elements in accordance with the present invention. Hereinafter, for simplicity, the present invention will be explained with reference to FIGS. 3 and 4. However, it should be understood that FIGS. 3 and 4 are provided as examples, and the present invention should not be construed to be limited to what is shown in FIGS. 3 and 4. The smart antenna may comprise any configuration and may use any number of active elements and passive elements.

The smart antenna 300 shown in FIG. 3 comprises one active element 302, three passive elements 304 and a ground plane 306. The active element 302 is installed on top center portion of the ground plane 306. The active element 302 is electrically isolated from the ground plane 302 and fed by a generator or receiver (not shown) through a feeding cable 308.

The passive elements 304 surround the active element 302. FIG. 3 shows only three (3) passive elements 304. However, more than three (3) passive elements may be utilized. Each passive element 304 comprises an upper half 304*a* and a lower half 304*b*. The upper halves 304*a* are located on top of the ground plane 306 around the edge of the ground plane 306 and the lower halves 304*b* are located on the bottom of the ground plane 306 around the edge of the ground plane 306. The upper halves 304*a* and the lower halves 304*b* may or may not be vertically aligned.

Each upper half 304*a* of the passive elements 304 is connected to the ground plane 306 through a reactive load 312, respectively. Each lower half 304*b* of the passive elements 304 is also connected to the ground plane 306 through a reactive load 314, respectively. The reactive loads 312, 314 are variable reactance, which is changeable from capacitive to inductive by using varactors, transmission lines, or switching. A reactance on the passive element 304 has an effect of lengthening or shortening the passive element 304. Inductive loads lengthen, and capacitive loads shorten, the electrical length of the passive element 304.

By varying the reactive loads of the upper halves 304*a* and the lower halves 304*b*, the radiation pattern can be changed both in azimuth and elevation. A beam is tilted up and down in elevation in accordance with the ratios of the reactive loads 312 of the upper halves 304*a* and the reactive loads 314 of the lower halves 304*b*. For example, if the electrical length of the lower half 304*b* is shortened compared to the electrical length of the corresponding upper half 304*a*, the beam is tilted upward. By adjusting these ratios, the beam can point up and down in elevation, and all around in azimuth.

FIG. 4 is a diagram of another example of smart antenna 400 with one active element 402 and two passive elements 404. The active element 402 is on top preferably in the center, of the ground plane 406. The active element 402 is electrically isolated from the ground plane 402 and fed by a generator 410 or receiver.

The two passive elements 404 are located left and right end of the ground plane 406, respectively. Each passive element 404 comprises an upper half 404*a* and a lower half 404*b*. The upper halves 404*a* and the lower halves 404*b* may or may not be vertically aligned.

Each upper half 404*a* of the passive elements 404 is connected to the ground plane 406 through a reactive load 412. Each lower half 404*b* of the passive elements 404 is also connected to the ground plane 406 through a reactive load 414. The reactive loads 412, 414 are variable reactance, which is changeable from capacitive to inductive by using varactors, transmission lines, or switching. A reactance on the passive element 404 has the effect of lengthening or shortening the passive element 404. Inductive loads lengthen, and capacitive loads shorten, the electrical length of the passive element 404. A beam is tilted up and down in elevation in accordance with the ratios of the reactive loads 412 of the upper halves 404*a* and the reactive loads 414 of the lower halves 404*b*. By adjusting the ratio, the beam can point up, down, and all around.

Figure 5:
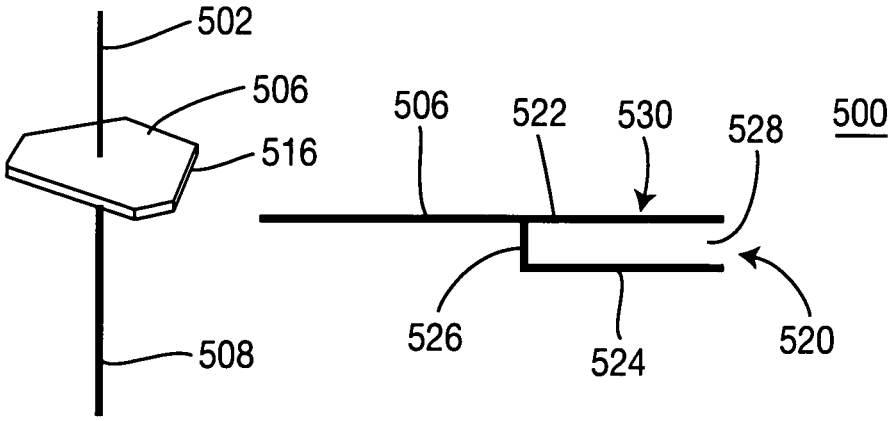
FIG. 5 is a diagram of an antenna with a radio frequency (RF) choke formed in the ground plane in accordance with the present invention.

FIG. 5 is a diagram of a smart antenna 500 in accordance with another embodiment of the present invention. The smart antenna 500 comprises an active element 502 and a ground plane 506 with a radio frequency (RF) choke 520. The ground plane 506 is a finite plane compared to the wavelength of transmitted and received signals. Therefore, the ground plane 506 operates as a source of scattering, which re-radiates radio waves and interferes with the beam directly radiated from the active element 502 to result in a tilted beam. The present invention controls the scattering of a radio wave caused by the ground plane 506 by including the RF choke 520 at the edge of the ground plane 506.

The active element 502 is installed on top, (preferably in the center), of the ground plane 506. The active element 502 is fed by a feeding cable 508. FIG. 5 shows only one active element. However, it should be noted that FIG. 5 is provided just as an example, not as a limitation. More particularly, more than one active element may be provided for radiating radio waves and more than one passive element may be provided for forming the radiation pattern. The active elements may be parallel or may not be parallel to provide for polarization diversity. The active elements may be straight line implementation or may not be straight line implementations. The active element may be flanked by one or more passive elements which are provided for forming the radiation pattern. The antenna element curvature may be right angle, fractal, curved, or any other curvature. Additionally, any type of antenna, (antenna array or a MIMO array), may be utilized instead of a singal element antenna. The active and passive elements can be perpendicular to the ground plane, or angled relative to each other to provide polarization diversity in two or three dimensions.

The RF choke 520 is placed on the rim 516 of the ground plane 506. The RF choke 520 may be continuous around all or a portion of the rim 516 of the ground plane 506. Alternatively, a plurality of RF chokes 506 may be installed in series. The RF choke 520 is a parallel plate waveguide 530, which can be, for example, a printed circuit board with two conducting surfaces. The RF choke 520 can also be transmission lines or lumped elements that fit the geometry of the edge 516 of the ground plane 506. The shunt 526 can be conducting rivets or an electrical equivalent. The distance between the shunt 526 and the opening 528 determines the impedance at the waveguide opening. For example, for infinite impedance at the opening 528, the distance between the shunt 526 and the opening 528 should be a quarter-wavelength of the transmitted or received signals.

Figure 6:
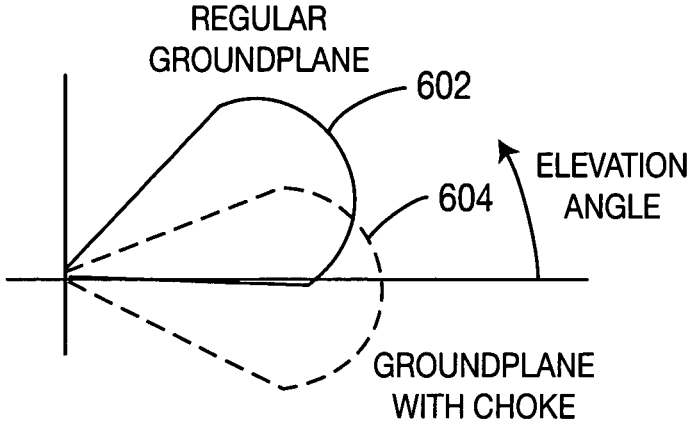
FIG. 6 is a diagram showing the effect of an RF choke in the antenna of FIG. 5.

FIG. 6 is a diagram showing the effect of an RF choke 520 in the antenna 500 of FIG. 5. While a prior art ground plane without an RF choke produces a beam 602 with a tilt, the smart antenna 500 with the RF choke 520 in accordance with the present invention restores the beam 604 to point towards horizon. When scattering is completely eliminated, the beam 604 points towards the horizon. By adjusting the phase of the scattering, the beam tilt and depression is made variable. Therefore, it is possible to electronically control the beam to point at a desired elevation angle.

Figure 7:
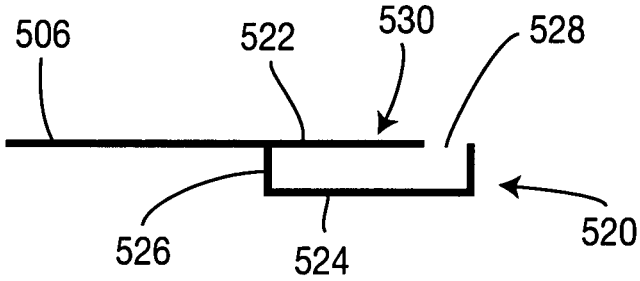
FIG. 7 is a diagram of an alternative embodiment of an RF choke in accordance with the present invention.

FIG. 7 is a diagram of a variation of an RF choke 520 in accordance with the present invention. In FIG. 7, an opening 528 of the waveguide 530 points upward. The RF choke 520 can be configured in many different ways. The configuration shown in FIG. 7 is just one of the many possible variances. Multiple chokes 520 may be installed in series to increase the choking effect.

Figure 8:
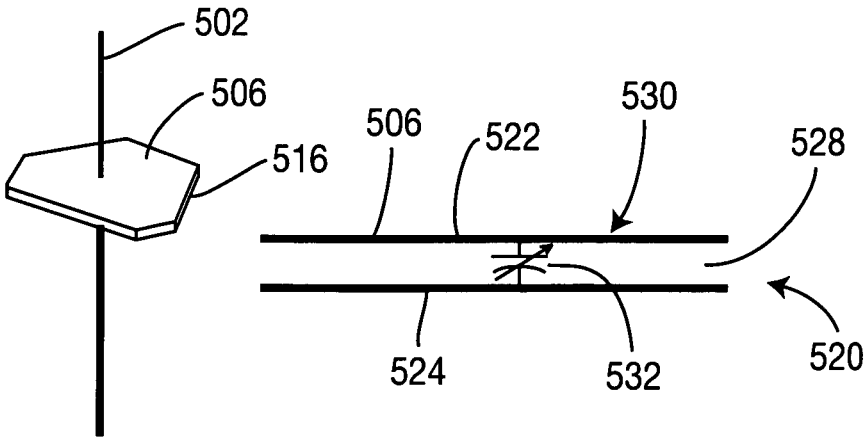
FIG. 8 is a diagram of an antenna with another alternative embodiment of an RF choke in accordance with the present invention.

FIG. 8 is a diagram of an antenna with another embodiment of an RF choke 520 in accordance with the present invention. The shunt 526 in FIG. 5 is replaced by a variable reactive load 532 in FIG. 8. The variable reactive load 532 makes the beam tilt electronically controllable. The reactive load 532 can be switched to change its reactance, or may be biased as with a varactor. With variable reactive loads 532, the placement of the loads is more flexible. The reactive loads 532 can be placed anywhere from the opening 528 inward. Multiple reactances can be placed in the waveguide 530 to approximate a continuous wall of reactance, and the values of the reactiances at different locations can be different, so the beam tilt can be a function of the azimuth angle.

It should be noted that the structure of the RF choke 520 is not limited to what is shown in FIGS. 5–8, but may be modified without departing the teachings of the present invention.

Figure 9:
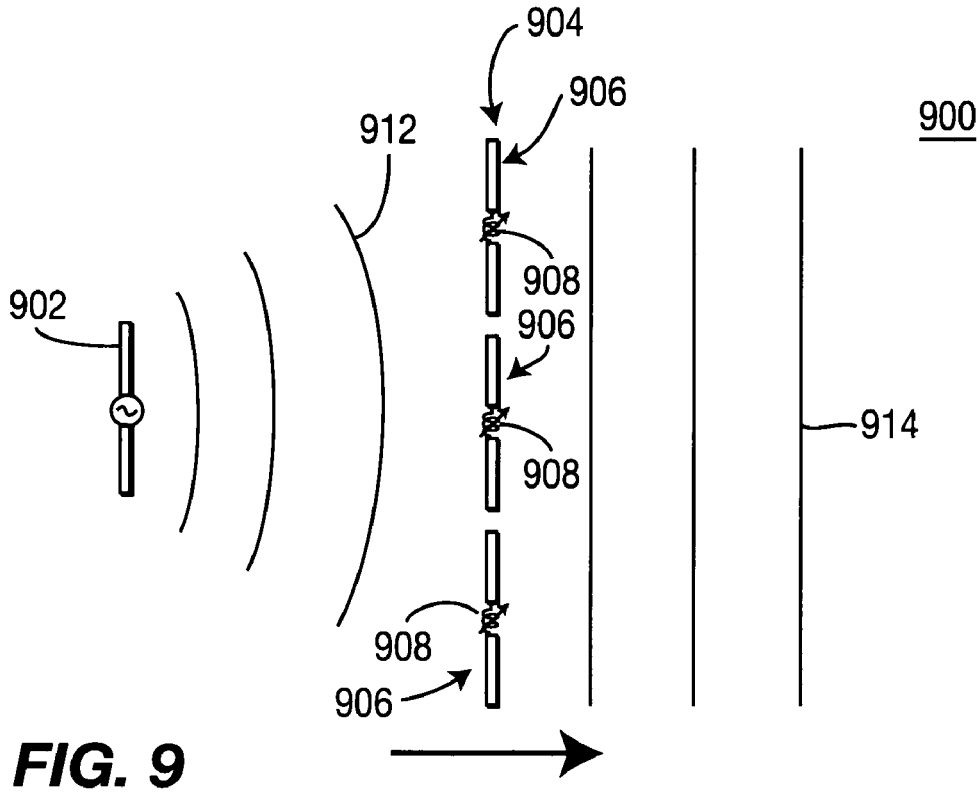
FIGS. 9 and 10 illustrate the use of a variable lens to convert the wave front in accordance with the present invention.
Figure 10:
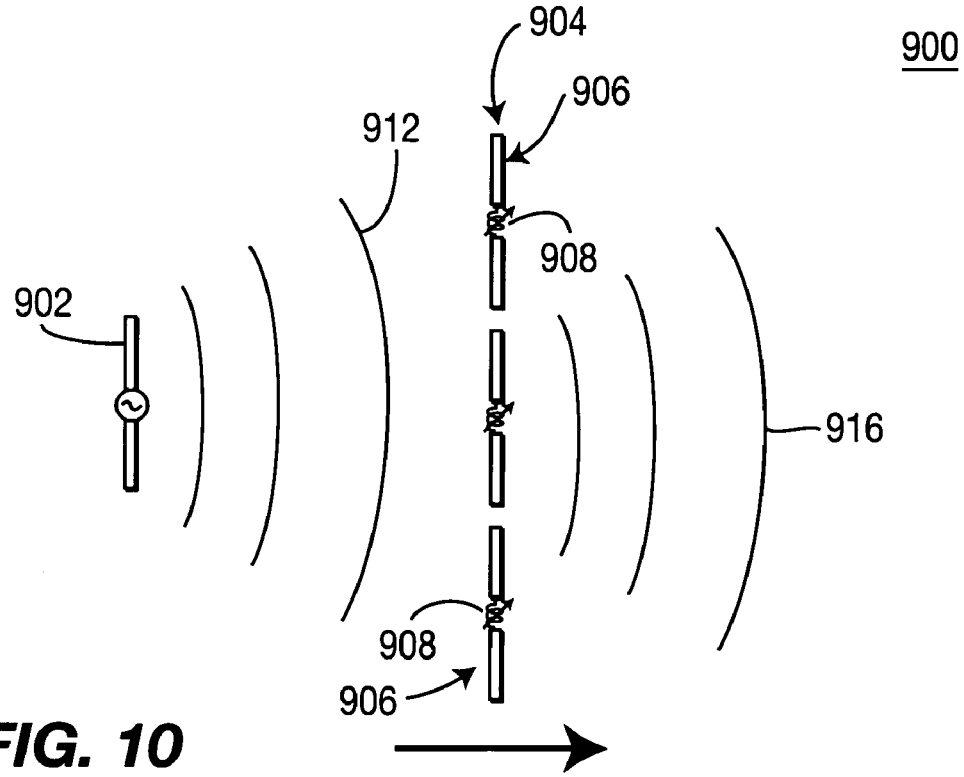

FIGS. 9 and 10 show an antenna 900 with a variable lens 904 in accordance with the present invention. The antenna 900 comprises a radiating antenna 902 and a variable lens 904. The variable lens 904 changes the wave front of the radio waves passing through the lens 904, whereby can change both beam direction and the beam shape at the same time. The antenna 900 can be operated reciprocally, (i.e., incoming and outgoing). The variable lens 904 comprises a plurality of lens elements 906. Each lens element 906 comprises a means for adjusting the phase delay of the radio waves passing through. The means for adjusting a phase delay is a variable reactive load which controls the amount of phase delay as the wave passes through each element. Alternatively, it can be switched loads, varactors, or ferro-electric or ferro-magnetic materials that respond to biases, (voltage and currently, respectively). Mono pole may be used instead of dipole, and it should be noted that the configuration shown in the FIGS. 9 and 10 is provided as an example, not as a limitation, and any other configuration may be implemented. The distribution of the phase delay shapes the wave front.

In FIG. 9, the variable reactance 908 in each radiating element 906 of the variable lens 904 depicts a controllable delay. It controls the amount of phase delay as the wave passes through each element. The distribution of the delay shapes the wave front. In FIG. 9, parasitic dipoles are used as radiation elements 906, which act as radiation directors that allow the waves to pass through rather than reflect. The variable lens 904 can be any type of lens which is configured to change the shape of the wave front of a passing radio wave. For example, an antenna pair, where one receives and then sends it to the next one that transmits, can also be used as the elements of the variable lens.

In FIG. 9, a radio wave 912 is radiated by the radiating antenna 902 from the left to the right, as indicated by an arrow. The radio wave 912 is radiated by the antenna 902 as a circular wave. As the radio wave 912 passes through the variable lens 904, the lens 904 converts the radio wave 912 having a circular wave front to a collimated beam 914 having a planar wave front. A beam having a planar wave front is narrower than a beam having a circular wave front. The narrowness of the beam is inversely proportional to the radius of the resulting wave front.

FIG. 10 shows the same arrangement but the lens 904 is biased to curve the wave front, instead of generating a planar wave. The wave front of a radio wave 912 radiated from the radiating antenna is made more curved by the lens 904 resulting in a broader beam 916.

Figure 11A:
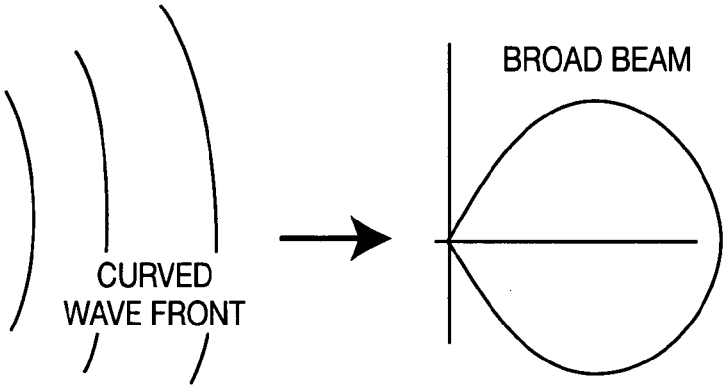
FIGS. 11A and 11B illustrate the creation of wide beam and narrow beam in accordance with the present invention.
Figure 11B:
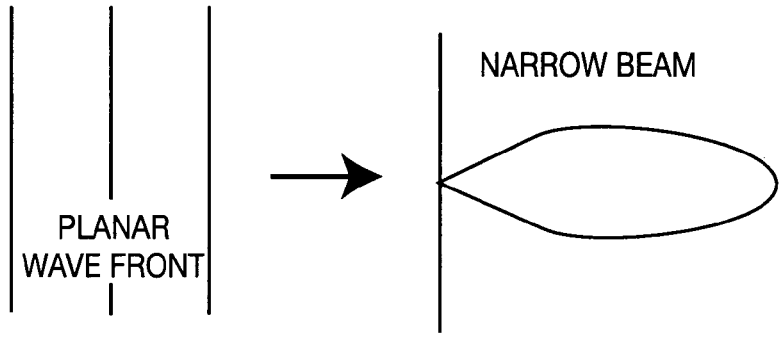

FIGS. 11A and 11B illustrate the control of beam width in accordance with the present invention. The curved wave front is converted to a broader beam in FIG. 11A, whereas a planar wave front is converted to a narrower beam in FIG. 11B. Waves propagate in the direction normal to the wave front. The portions of the wave front that are not normal to the direction of propagation cancel each other, and have minimized their contribution to the intensity of the wave. This principle leads to the radiation property that a curved wave front has a broad beam, and a planar wave front has a higher intensity narrow beam.

Figure 12:
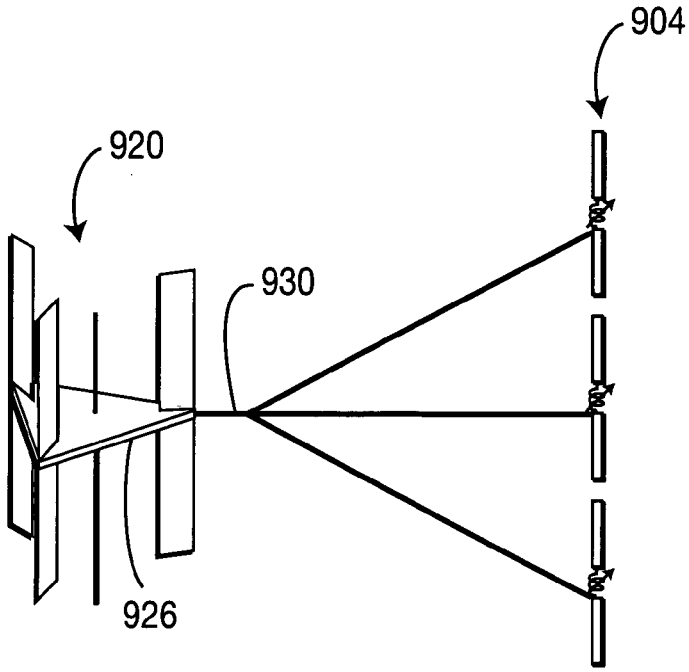
FIG. 12 shows the installation of a variable lens to the smart antenna in accordance with the present invention.

FIG. 12 shows the installation of a variable lens 904 to an antenna 920 in accordance with the present invention. A variable lens 904 is added on to the antenna 920. FIG. 12 shows a typical SBSA including one active element in the center, and three passive elements surrounding the active element. It should be noted that the antenna 920 shown in FIG. 12 is provided just as an example, not as a limitation, and the antenna 920 may be any type of antenna, (i.e., an omni-directional antenna or a directional antenna), or may be one of the smart antennas disclosed hereinabove in the present invention including a delta array or a tri-element antenna.

The antenna 920 includes an extension 930 attached to the ground plane 926 in a radial manner. The support of the lens 904 is provided by the ground extension 930. The ground extension 930 also houses control lines (not shown) to control the variable lens 904 for beam direction and width control. The extension 930 is shaped such that it presents a minimum blockage to the polarized wave coming from the smart antenna 920.

Only one set of lens is shown in FIG. 12. Multiple variable lenses 904 can be added all around, or to a portion of, the smart antenna 920 to provide up to 360 degrees of azimuth control of elevation beam width. There should be at least 2 radiating elements 906 to each variable lens 904, so that the beam width can be changed.

Although the features and elements of the present invention are described in the preferred embodiments in particular combinations, each feature or element can be used alone without the other features and elements of the preferred embodiments or in various combinations with or without other features and elements of the present invention.

What is claimed is:

1. An antenna configured to steer a beam both in azimuth and elevation, comprising:

a ground plane;

at least one active element for radiating a radio beam, the active element being installed on top of the ground plane while electrically isolated from the ground plane; and a plurality of passive elements disposed around the outer edge of the ground plane, each passive element comprising:

an upper half including a variable reactive load which connects the upper half to the ground plane; and a lower half including a variable reactive load which connects the lower half to the ground plane, whereby elevation angle of the radio beam radiated from the antenna is controlled by adjusting the variable reactive loads.

2. The antenna of claim 1 wherein the smart antenna comprises one active element and three passive elements.

3. The antenna of claim 1 wherein the smart antenna comprises one active element and two passive elements.

4. The antenna of claim 1 wherein the upper half and the lower half are vertically aligned.

5. The antenna of claim 1 wherein the upper half and the lower half are not vertically aligned.

6. An antenna comprising:

a ground plane;

an active element for radiating a radio beam, the active element being installed on top of the ground plane while electrically isolated from the ground plane; and a radio frequency (RF) choke disposed around the edge of the ground plane, whereby an elevation angle of the radio beam is controlled by controlling the RF choke.

7. The antenna of claim 6 wherein the RF choke is a parallel plate waveguide.

8. The antenna of claim 7 wherein the waveguide includes an opening and the opening of the waveguide is disposed upward.

9. The antenna of claim 7 wherein the waveguide includes a reactive load between the parallel plates.

10. The antenna of claim 9 wherein more than one reactive load is installed between the parallel plates.

11. The antenna of claim 10 wherein each reactive load has different reactance.

12. The antenna of claim 6 wherein the RF choke is continuous around the edge of the ground plane.

13. The antenna of claim 6 wherein a plurality of RF chokes are installed in series around the edge of the ground plane.

14. The antenna of claim 6 wherein more than one active elements are provided for radiating radio waves.

15. The antenna of claim 14 wherein the active elements are not parallel to provide for polarization diversity.

16. The antenna of claim 14 wherein the active elements are not straight line implementations.

17. The antenna of claim 6 wherein the active element is flanked by one or more passive elements which are provided for forming the radiation pattern.

18. The antenna of claim 17 wherein more than one active element is provided and the active elements are not parallel to provide for polarization diversity.

19. The antenna of claim 6 wherein more than one active element are provided for radiating radio waves and one or more passive elements are provided for forming the radiation pattern.

20. The antenna of claim 6 wherein the active antenna element is not straight line implementations.

21. An antenna assembly for steering a radio beam both in azimuth and elevation, comprising:

an antenna for radiating a radio wave; and a variable lens for changing a wave front of the radio wave which passes through the variable lens, the variable lens comprising a plurality of radiating elements, each radiating element including a reactive load for controlling a phase delay, whereby the beam width of the radio wave is controlled by controlling the reactive load.

22. The antenna assembly of claim 21 wherein the number of the radiating elements is at least two.

23. The antenna assembly of claim 21 wherein the direction of the beam is controlled by controlling the reactive load.

24. The antenna assembly of claim 21 wherein a plurality of variable lenses are disposed around the antenna.

25. The antenna assembly of claim 21 wherein the variable lens converts the radio wave into a narrower beam.

26. The antenna assembly of claim 21 wherein the variable lens converts the radio wave into a wider beam.

27. The antenna assembly of claim 21 wherein the antenna includes at least one active element.

28. The antenna assembly of claim 21 wherein the antenna comprises a plurality of passive elements.

29. The antenna assembly of claim 21 wherein the antenna is a delta array.

30. The antenna assembly of claim 21 wherein the antenna is a tri-element antenna.

* * * * *

UNITED STATES PATENT AND TRADEMARK OFFICE

CERTIFICATE OF CORRECTION

PATENT NO. : 7,193,574 B2
APPLICATION NO. : 11/065752
DATED : March 20, 2007
INVENTOR(S) : Chiang et al.

It is certified that error appears in the above-identified patent and that said Letters Patent is hereby corrected as shown below:

IN THE SPECIFICATION

At column 3, line 50, after the word "plane", delete "302" and insert therefor --306--.

At column 4, line 22, after the word "plane", delete "402" and insert therefor --406--.

At column 5, line 5, before word "element", delete "singal" and insert therefor --single--.

At column 5, line 52, after the words "of the", delete "reactiances" and insert therefor --reactances--.

At column 5, line 57, after the word "departing", insert --from--.

At column 5, line 63, after the word "whereby", insert --the variable lens--.

IN THE CLAIMS

At claim 19, column 8, line 21, before the words "are provided", delete "element" and insert therefor --elements--.

At claim 20, column 8, line 26, after the words "is not", delete "straight line implementations" and insert therefor --a straight line implementation--.

Signed and Sealed this

Twenty-fifth Day of September, 2007

JON W. DUDAS
*Director of the United States Patent and Trademark Office*